US008356500B2

(12) United States Patent
Werner et al.

(10) Patent No.: US 8,356,500 B2
(45) Date of Patent: Jan. 22, 2013

(54) METHOD AND DEVICE FOR CREATING A SYMBOL IN A WORKPIECE SURFACE VIA STAMPING

(75) Inventors: Wilfried Werner, Zierenberg (DE); Senel Efe Ok, Wolfhagen (DE)

(73) Assignee: Werner Maschinenbau GmbH, Wolfhagen (DE)

( * ) Notice: Subject to any disclaimer, the term of this patent is extended or adjusted under 35 U.S.C. 154(b) by 911 days.

(21) Appl. No.: 12/421,408

(22) Filed: Apr. 9, 2009

(65) Prior Publication Data

US 2009/0255306 A1 Oct. 15, 2009

(30) Foreign Application Priority Data

Apr. 15, 2008 (DE) ..... 10 2008 019 342

(51) Int. Cl.
*B21C 51/00* (2006.01)

(52) U.S. Cl. ..... 72/16.1; 72/31.01

(58) Field of Classification Search ..... 72/16.1, 72/16.2, 16.4, 17.3, 18.1, 18.2, 19.3, 28.1, 72/31.01, 37, 373

See application file for complete search history.

(56) References Cited

FOREIGN PATENT DOCUMENTS

| | | |
|---|---|---|
| DE | 199 30 272 | 1/2001 |
| DE | 10 2005 037 411 | 1/2007 |

OTHER PUBLICATIONS

Machine translation of DE19930272A1, Al-Obaidi, pp. 1-6.*

* cited by examiner

*Primary Examiner* — Teresa M Ekiert
(74) *Attorney, Agent, or Firm* — Michael J. Striker

(57) ABSTRACT

In a method and a device for creating a symbol in a workpiece surface via stamping (scoring or plastic forming under compressive conditions); the resultant stamping depth is measured and/or regulated constantly by using a distance sensor which is mounted on the stamping needle and is movable therewith. The stamping needle is placed on the workpiece surface before stamping is begun, thereby resulting in a first distance between the distance sensor and the workpiece surface. A second distance between the distance sensor and the workpiece surface is obtained during the subsequent stamping procedure, and when the stamping needle is pressed into the workpiece surface. The stamping depth results from the difference of the two distances.

15 Claims, 7 Drawing Sheets

METHOD AND DEVICE FOR CREATING A SYMBOL IN A WORKPIECE SURFACE VIA STAMPING

CROSS-REFERENCE TO RELATED APPLICATION

The invention described and claimed hereinbelow is also described in German Patent Application DE 10 2008 019 342.9 filed on Apr. 15, 2008. This German Patent Application, whose subject matter is incorporated here by reference, provides the basis for a claim of priority of invention under 35 U.S.C. 119(a)-(d).

BACKGROUND OF THE INVENTION

The present invention relates to a method and a device for creating a symbol in a workpiece surface via stamping.

The creation of symbols, e.g. alphanumeric characters, in workpiece surfaces is used, e.g. in the automotive industry to provide workpieces such as chassis, engines, or the like with largely unadulterable markings in the form of labeling or other types of identification. The stamping tools used for this purpose are stamping needles in particular, which compose the symbols in a matrix form using a plurality of points (needle stamping), or as plain text, in that the stamping needle is pressed into the workpiece surface and then moved transversely thereto (scoring or plastic forming under compressive conditions).

In the latter two cases, in which the individual symbols are designed as continuous, essentially V-shaped score lines or grooves, it is increasingly required in order to obtain a highly legible, uniform typeface that the symbols have a continuously uniform scoring or groove depth, referred to hereinbelow as the stamping depth, of, e.g. 0.2 mm. Since it is practically impossible to perform a final visual inspection of the stamping depth, and given that the stamping devices that are typically used do not ensure that a specified stamping depth may actually be attained and adhered to, methods and devices of the general classes described initially are required, using which the stamping depth is determined automatically, and using which it may be automatically ensured that a preselected stamping depth is always attained.

Known methods and devices of the general classes described initially use fully optical means to determine the stamping depth (e.g. DE 199 30 272 A1, DE 10 2005 037 411 A1), which include sensors, e.g. that operate using laser light. The disadvantage is that a working step must be carried out after the stamping in order to measure the stamping depth that was actually attained, and these methods are susceptible to contamination, in particular due to the unavoidable ejection of material that is displaced during scoring. The stamping depths attained therefore do not conform to the specified setpoint values with an adequate level of reliability. It is also known to first determine the distance between the stamping needle and the workpiece surface using a capacitive proximity sensor, and to then move the stamping needle in the direction of the workpiece surface. This method does not ensure a high level of accuracy, either, because the workpiece may bend during the stamping procedure, e.g. if it is designed as a piece of sheet metal, which then results in a stamping depth that is shallower than the desired stamping depth.

Finally, it would be possible to inspect the stamped labels using a camera. As a result, however, it is typically possible only to determine whether the desired symbols are actually present. In addition, any contaminating particles (ejected material) that are present, changing light conditions, and different colors of the workpieces have an unfavorable effect on the measured results, which is why poor availability is attained using these methods and devices as well.

SUMMARY OF THE INVENTION

Given these circumstances, the present invention is based on the technical problem of refining the method and the device of the general classes described initially in a manner such that it is possible to determine the stamping depth rapidly during the stamping procedure and with a high level of accuracy, thereby largely prevent workpieces from being labeled in an erroneous manner.

The advantage of the present invention is that the distance sensor which is moved together with the needle perpendicularly and parallel to the workpiece surface continually displays its distance away from the workpiece surface during the stamping procedure, thereby simultaneously providing an exact measure of the actual stamping depth since it accounts for a reference value that is determined at the beginning of the stamping procedure and when the stamping needle is placed on the workpiece surface. The more closely the distance sensor is situated on the stamping needle, the greater is the accuracy of the stamping depth that is determined, since this design neutralizes any bending of the workpiece that may take place. Finally, the influence of any wear of the stamping needle may be largely compensated for by determining a new reference value before any symbol is created.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The present invention is explained below in greater detail with reference to the attached drawings of an exemplary embodiment. The following figures show, in various scales.

DESCRIPTION OF THE PREFERRED EMBODIMENTS

Figure 1:
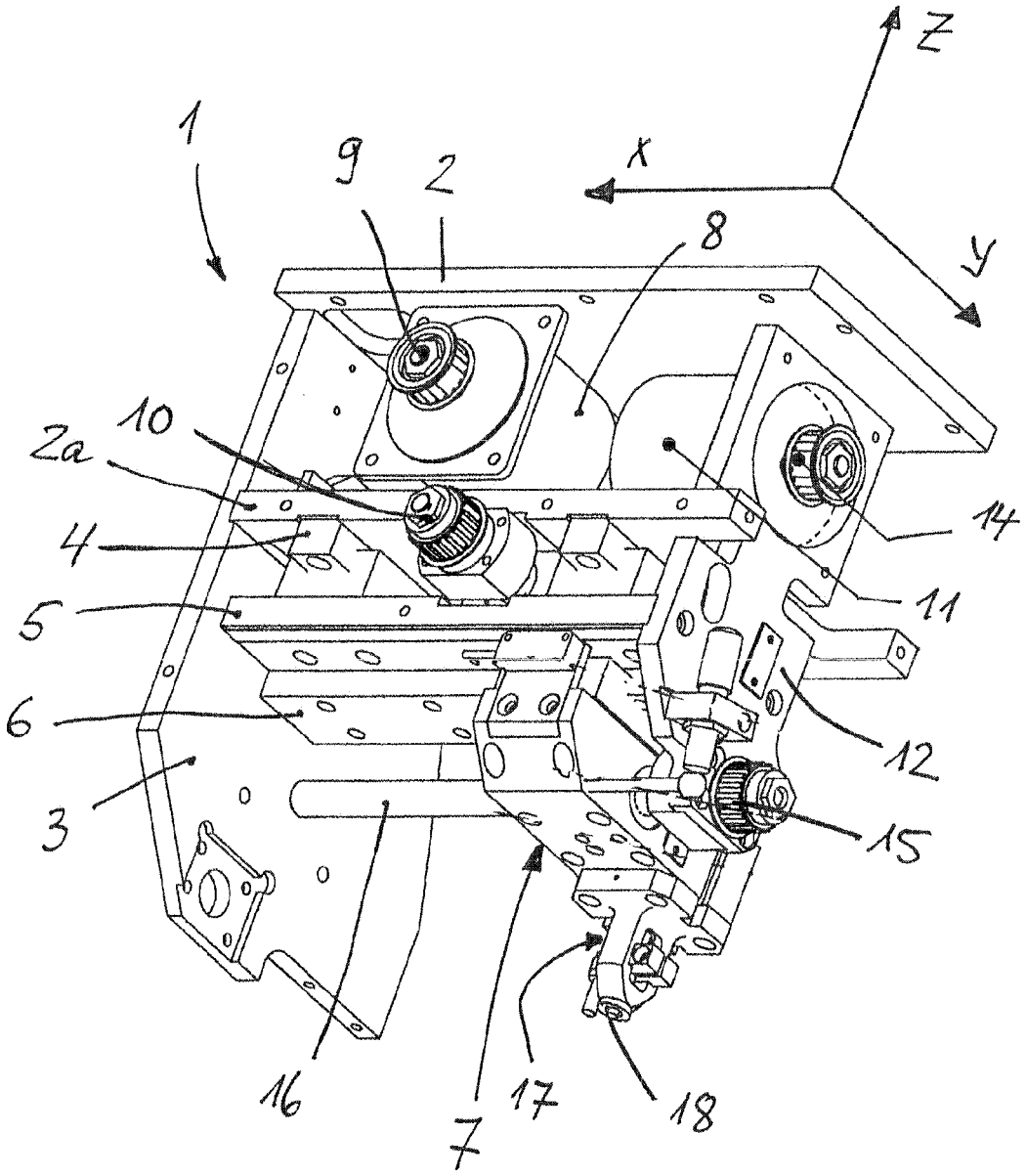
FIG. 1 shows a schematic, perspective view of a stamping unit that is used to form score marks.

FIG. 1 shows a device in the form of a stamping unit 1 for creating labels using the method of "scoring". Stamping unit 1 includes a main frame, of which only an upper cover plate 2, a side wall 2*a* parallel thereto, and a side panel 3 are shown in FIG. 1. The main frame is typically mounted on a handling system, such as a robotic arm, thereby enabling stamping unit 1 to be placed at the point on a workpiece surface where a label should be applied. At least one guide 4 which extends parallel to a y-axis of an imagined coordinate system is mounted on intermediate wall 2*a* of the main frame, along which a Y-carriage 5, which is depicted merely schematically, may be moved back and forth.

At least one guide 6 which extends parallel to the x-axis of the imagined coordinate system is mounted on an underside of Y-carriage 5, along which an X-carriage 7 is supported such that it may be moved back and forth. Y-carriage 5 is moved, e.g. using a stepping motor 8 which is mounted on the main frame and which drives a toothed belt pulley 10 via a toothed belt pulley 9 and a not-shown toothed belt, toothed belt pulley 10 being mounted on a threaded spindle which extends through a threaded bore in Y-carriage 5. In a similar manner, X-carriage 7 is driven, e.g. using a stepping motor 11 which is mounted on Y-carriage 5 using a supporting plate 12 and which includes a toothed belt pulley 14 which may start a toothed belt pulley 15 rotating using a not-shown toothed belt. Toothed belt pulley 15 is mounted on a threaded spindle 16 which is rotatably supported in support plate 11, and which extends through a threaded bore in X-carriage 7.

A stamping needle or needle head 17 is mounted on the underside of X-carriage 7 in a manner such that a stamping needle 18 is movably supported and may be moved back and forth parallel to the z-axis of the imagined coordinate system.

As for the rest, stamping unit 1 described so far may be designed in a manner that conforms with the general related art. Therefore, stepping motors 8 and 11 in particular, as is common for XY tables, may be set into rotation using not-shown control units in a manner such that stamping needle 18 is moved in the x-direction and the y-direction along the surface of a workpiece that is not shown in FIG. 1, in order to write one or more symbols and to form them in the workpiece surface using a scoring procedure. Since controls of this type are commonplace to a person skilled in the art, they will not be described in greater detail.

Figure 3:
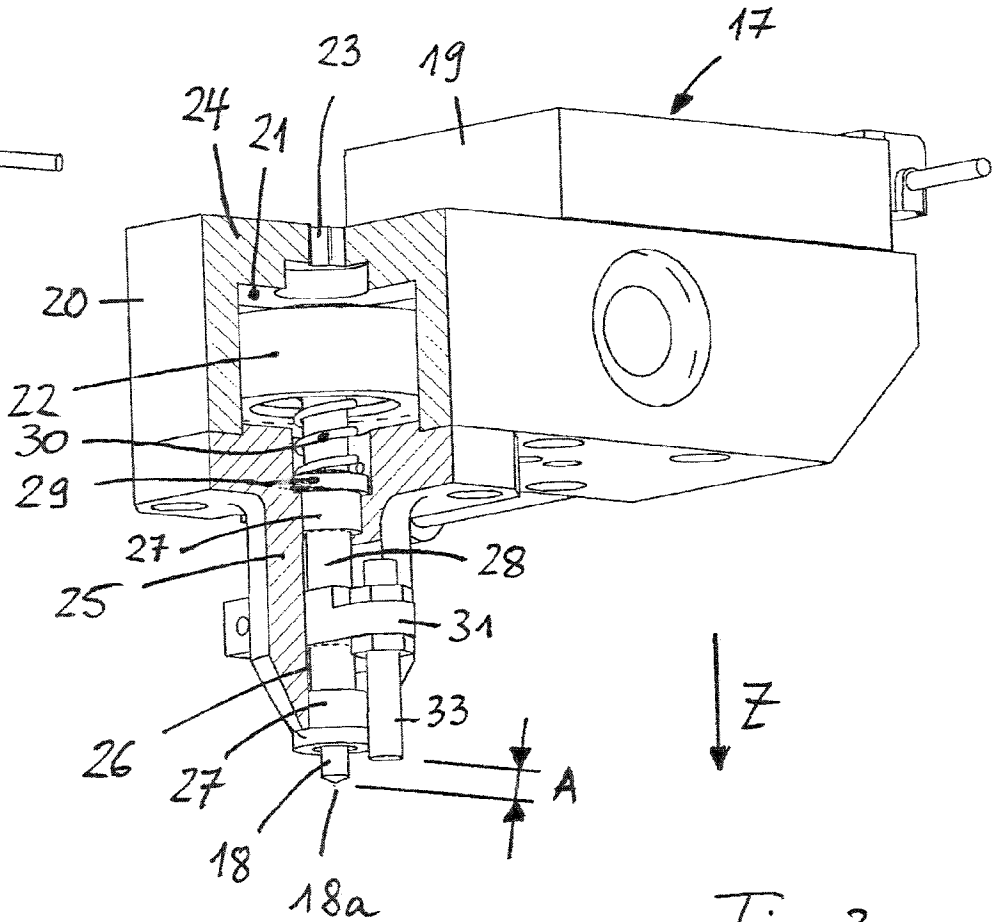
FIG. 3 shows the needle head in FIG. 2 in a partially exposed and cut view.
Figure 2:
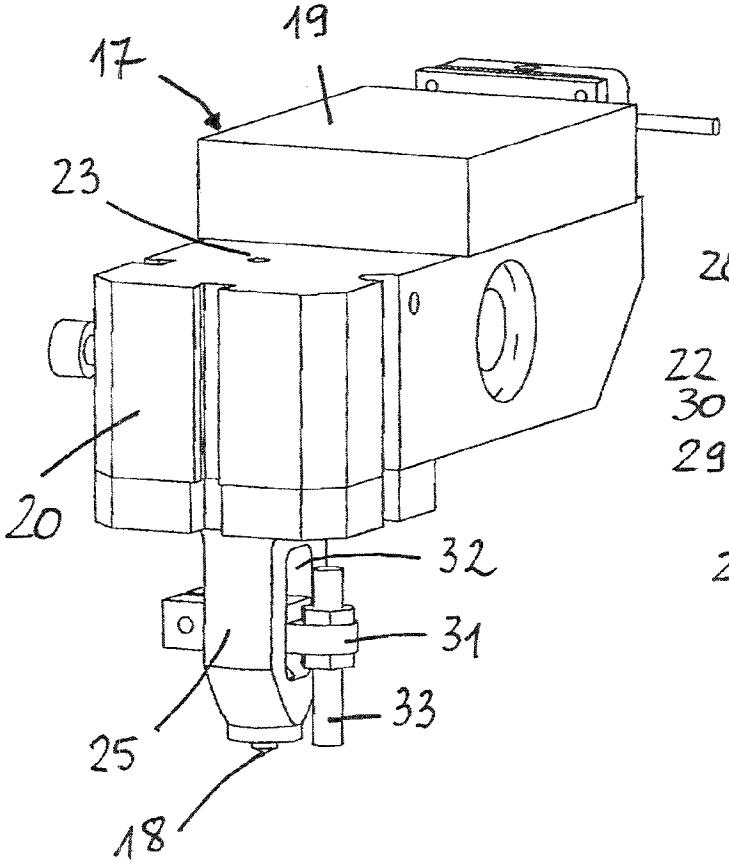
FIG. 2 shows a perspective view of a needle head of the stamping unit in FIG. 1.

FIGS. 2 and 3 show details of needle head 7 which is mounted on X-carriage 7. It includes, in an upper part, a retaining plate 19, on the underside of which a housing 20 is mounted, housing 20 enclosing a preferably cylindrical cavity 21. A piston 22 which is also preferably cylindrical in design is supported in cavity 21 such that it may be displaced in the z-direction, as the means for pressing stamping needle 18 into the workpiece surface; in combination with housing 20, piston 22 forms a cylinder/piston system. An upper—as shown in FIG. 3—end of cavity 21 is closed by a cover wall 24 which includes a continuous opening 23. Opening 23 is used to introduce a pressure medium, preferably compressed air, into cavity 21 via a not-shown line which is connected to opening 23, thereby acting on piston 22.

A base part 25 is attached on the side of piston 22 facing away from opening 23, and includes a guide bore 26 which extends in the z-direction and is coaxial with piston 22. Guide projections 27 having a sliding fit are displaceably supported in guide bore 26; guide projections 27 are provided on a piston rod 28 which is mounted on piston 22, and on the lower end of which stamping needle 18 is mounted, preferably in an easily-replaceable manner (see also FIGS. 5 and 6). A ring 29 which loosely encloses piston rod 28 rests on a shoulder formed on a transition from cavity 21 to guide bore 26, and supports the lower end of a compression spring 30, the upper end of which bears against piston 22. As a result, piston 22 in FIG. 3 is preloaded upwardly into a home position, from which it may be displaced in the z-direction and downwardly, as shown in FIG. 3, via the pressure medium introduced into cavity 21 through opening 23.

A radially extending holder 31 which extends outwardly through a side recess 32 (FIG. 2) in base part 25 is installed in a lower section of piston rod 28. A distance sensor 33 which extends parallel to stamping needle 18 is installed in holder 31, recess 32 being designed in a manner such that holder 31 and, therefore, distance sensor 33 may follow all of the movements that stamping needle 18 makes in the z-direction. The lower end of distance sensor 33 is situated at a distance A (FIG. 3) from the underside or tip 18*a* of stamping needle 18 that is at least so great as the desired stamping depth of the symbol to be created. Distance A is preferably also greater than the stamping depth by an amount that corresponds to a tolerable amount of wear of stamping tip 18*a* during use. As a result, distance sensor 33 is always situated above a workpiece surface and therefore does not touch it, even when stamping needle 18 is pressed into workpiece surface to the maximum stamping depth.

Figure 4:
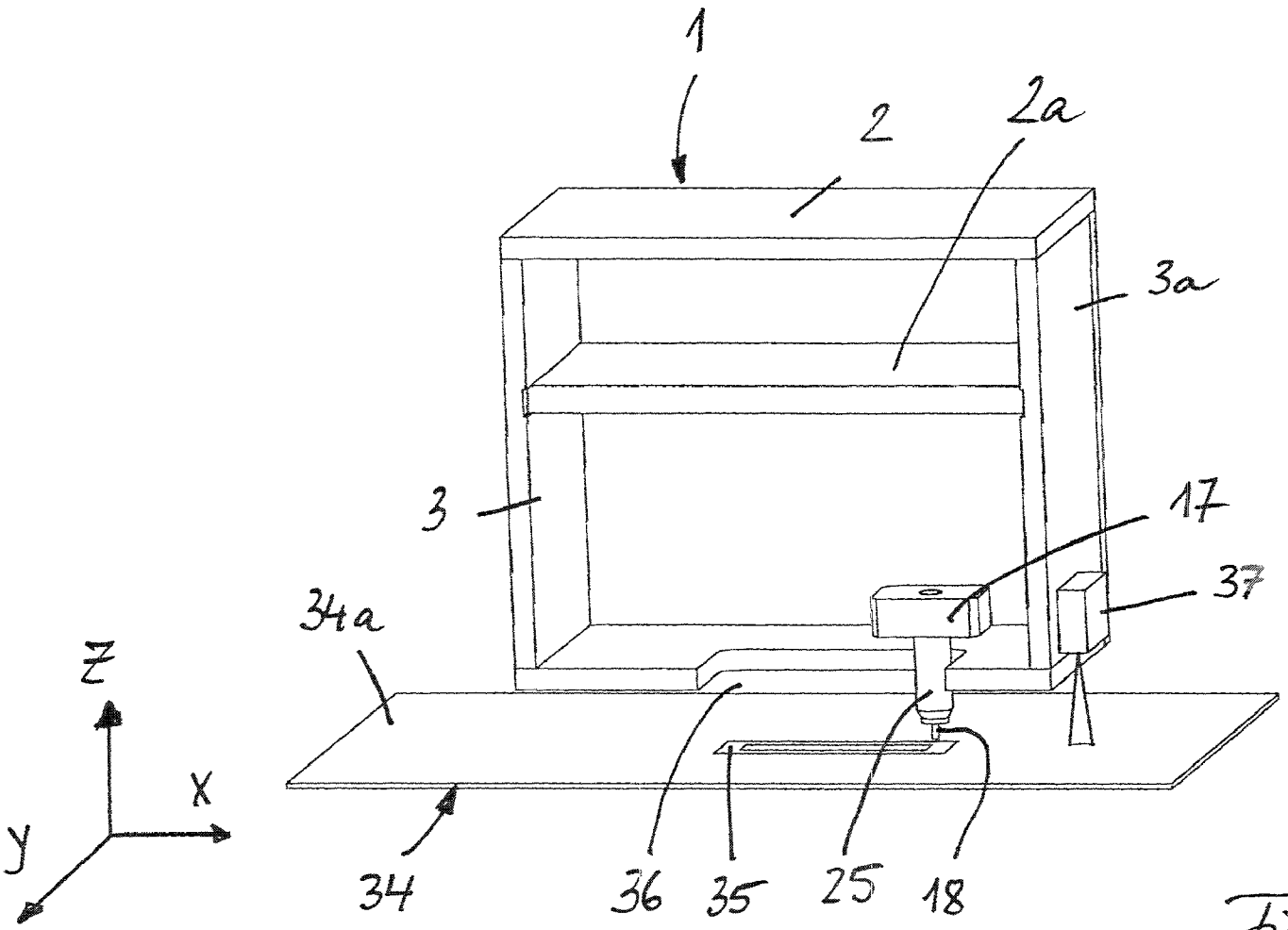
FIG. 4 shows a perspective illustration of a device which includes an optical sensor for detecting relative movements between the stamping unit and the workpiece.

FIG. 4 shows a workpiece 34 with a surface 34*a* to be labeled, and, greatly simplified, the setting down of stamping unit 1 using a robotic arm or the like on surface 34*a* in a manner such that stamping needle 18 may be moved back and forth parallel to surface 34*a* and along a labeling zone 35 to be provided with symbols using X-carriage 7 and Y-carriage 5 (not depicted here). For this purpose, base part 25 expediently extends through a recess 36 formed in a base of the main frame. A sensor 37 is situated on a further side wall 3*a* of the main frame of stamping unit 1, which is opposite to side wall 3; sensor 37 is, e.g. an optical sensor, and transmits a light beam directed toward surface 34*a* and receives a light beam that is reflected by surface 34*a*. Based on the sensor signals that are received in this manner, it may be determined in the manner of a motion sensor whether stamping unit 1 is moving during a stamping phase in the x-direction or y-direction relative to work piece 34, or whether a relative movement of this type is not taking place, as is required. The stamping procedure many be interrupted if necessary so that stamping unit 1 may be stored on workpiece 34 without being displaced.

Figure 6:
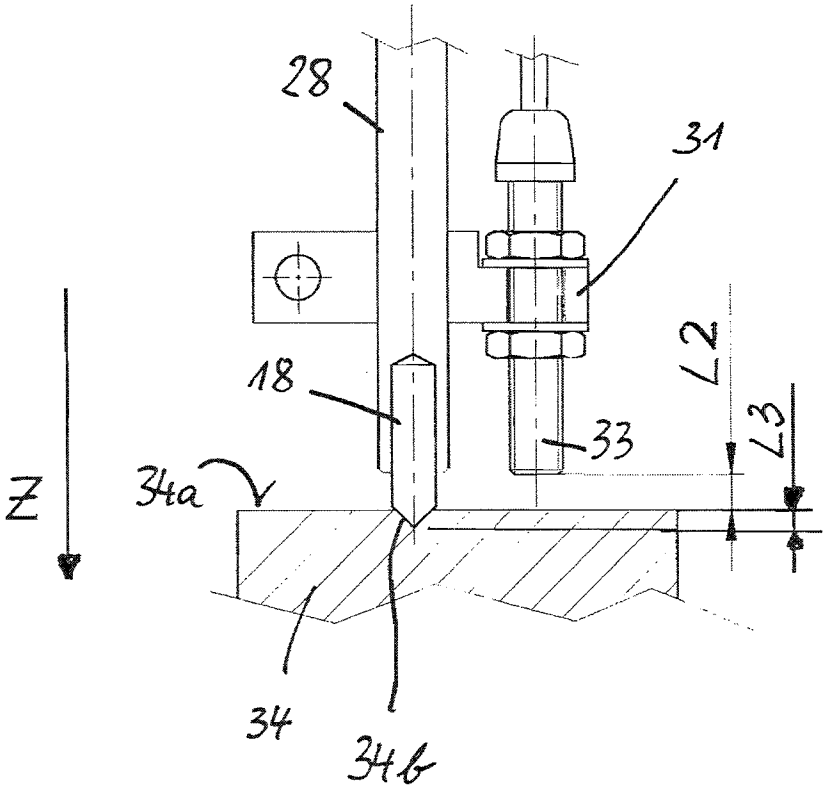
FIGS. 5 and 6 show the measurement principle—on which the present invention is based—for the stamping step using a front view of the stamping needle and a front view of a distance sensor.
Figure 5:
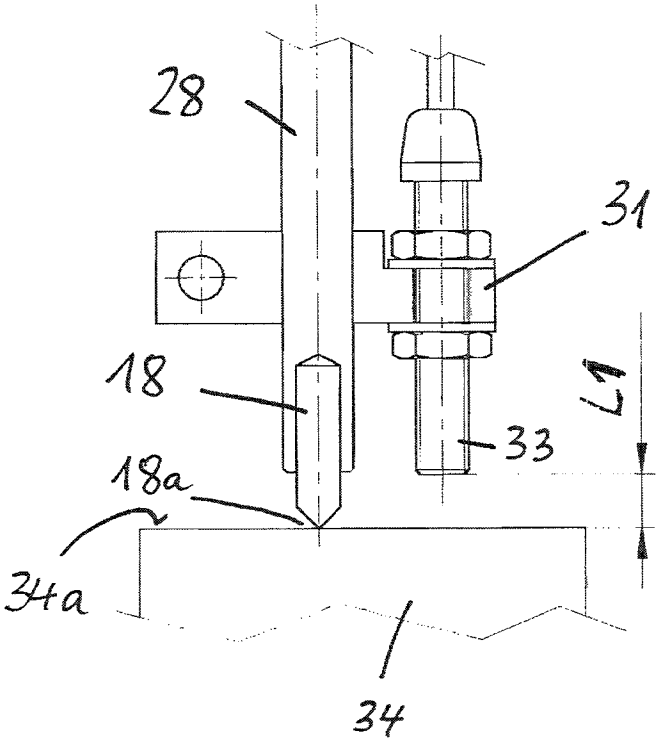

FIGS. 5 and 6 show how an exact measurement of the stamping depth may be carried out using distance sensor 33 when surface 34*a* should be provided with a symbol 34*b* (FIG. 6) via scoring. Before the scoring procedure is started, stamping needle 18 is initially displaced—via the application of a first, relatively low pressure on piston 22 (FIG. 3) through opening 23—so far in the z-direction that its tip 18*a* touches surface 34*a* without penetrating it. The attainment of this state may be monitored, e.g. using a not-shown sensor, e.g. a velocity sensor, an electrical contact sensor that displays the contact between tip 18*a* and surface 34*a*, or the like, which is assigned to piston 22 or piston rod 28 and emits a signal when velocity v=0 has been reached, which indicates that stamping needle 18 has come to a standstill or that contact has taken place. As an alternative, the pressure of the pressure medium may also be selected in a manner such that stamping needle 18 may come in contact with surface 34*a* but not penetrate it, and such that a specified waiting period transpires, within which stamping needle 18 will have certainly been placed on workpiece surface 34*a*. The end state that is attained is depicted in FIG. 5, in which distance sensor 33 (or its underside which faces surface 34*a*) is situated a first distance L1 away from workpiece surface 34*a*.

In a subsequent method step, the pressure of the pressure medium introduced through opening 23 is increased to such an extent that tip 18*a* of stamping needle 18 penetrates surface 34*a* to a desired stamping depth L3, as shown in FIG. 6. When stamping depth L3 has been reached, distance sensor 33 emits a signal L2 which corresponds to the value L2=L1−L3. The result is that actual stamping depth L3 is always equal to the difference L1−L2. If distance L1 which is measured when stamping needle 18 is placed on surface 34*a* is therefore used as the reference value in the subsequent creation of a symbol 34*b* via scoring, then difference L3=L1−L2 indicates the actual value at every point of symbol 34*b* which is being formed. As a result, it is possible, according to the present invention, to measure actual stamping depth L3 during a stamping procedure permanently, and to change it as necessary by controlling the pressure which acts on piston 22. Compression spring 30 returns stamping needle 18 in a direction which faces away from workpiece surface 34*a*.

Figure 7:
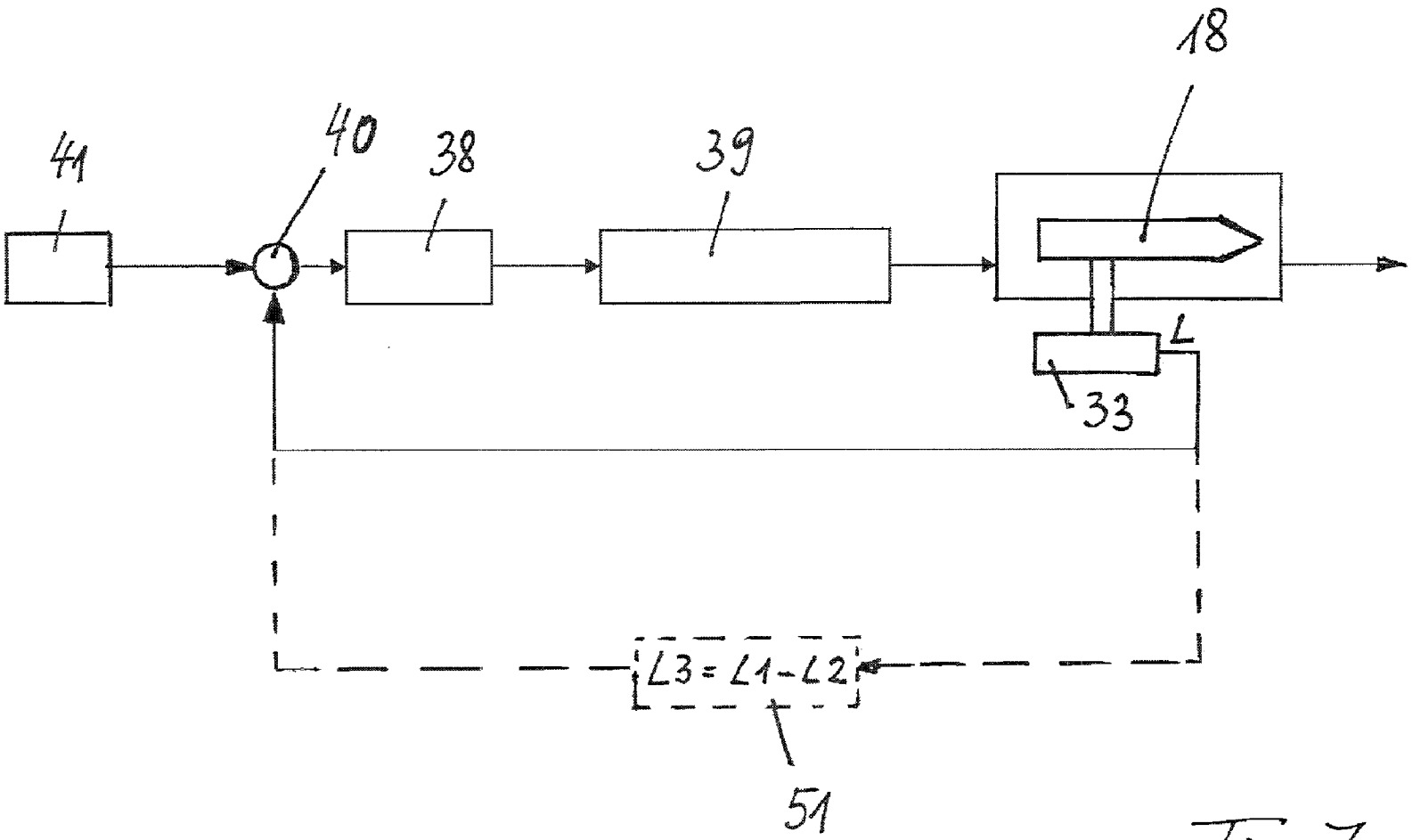
FIG. 7 shows a control setup for regulating the stamping depth using the stamping unit shown in FIGS. 1 through 5.
Figure 8:
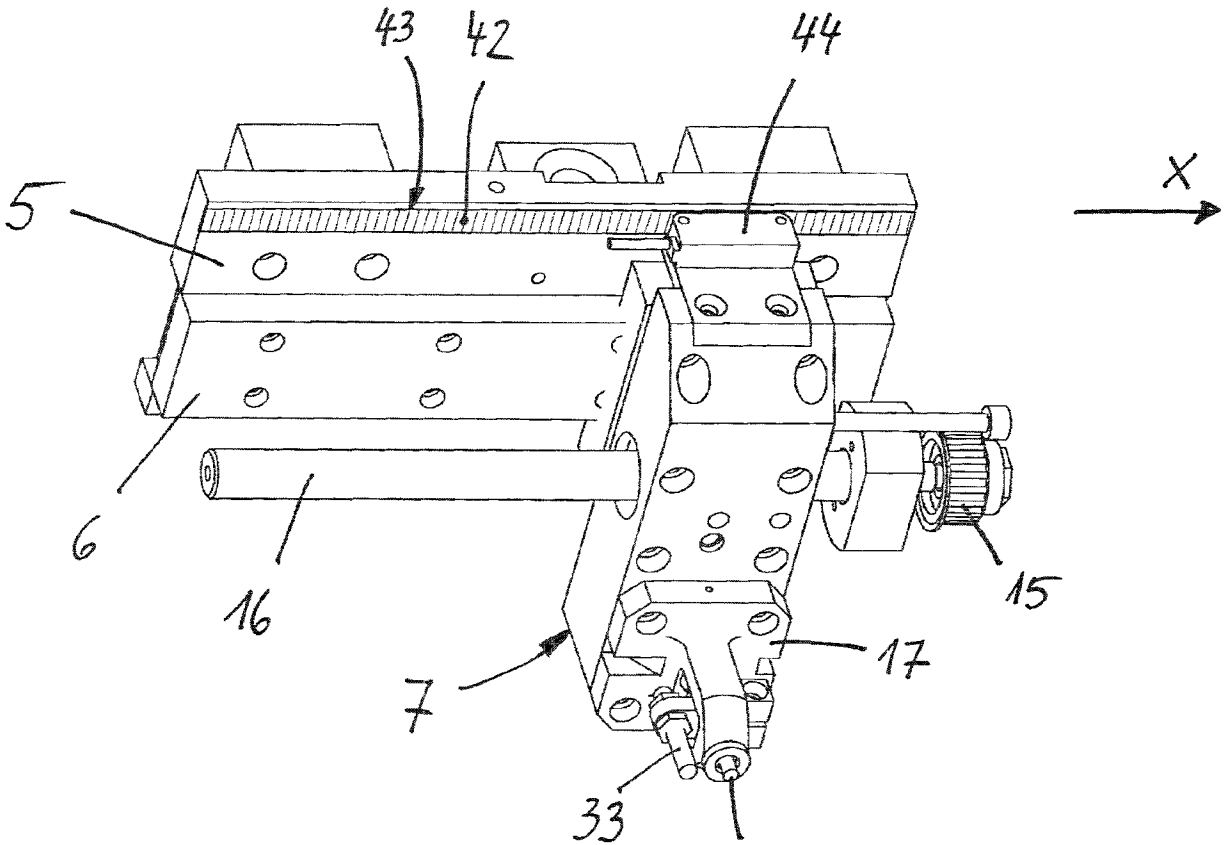
FIG. 8 shows a device for monitoring the movement of the stamping needle parallel to a workpiece surface.

In an embodiment of the present invention which is currently considered to be the best, difference L3=L1−L2 is used as the controlled variable for a control setup which determines the pressure to be applied to piston 22, and which is shown in FIG. 7 in a simplified form. The control setup includes a controller 38, a controlling device 39 which is connected to controller 38 and is designed, e.g. as a pressure control valve which is connected in a line which is connected to opening 23 (FIG. 1) and controls the pressure of the pressure medium which acts on piston 22, and stamping needle 18 which is acted upon by controlling device 39 and which is fixedly connected to distance sensor 33. The signal that is emitted by distance sensor 33 is sent to a comparator 40, in which it is compared with a specified setpoint value that was provided by a desired value generator 41. The differential signal that results from the comparison is sent to controller 38.

When stamping unit 1 is operated, the controller preferably operates as follows:

Before the stamping of a symbol 34*b* begins, stamping needle 18 is preferably placed—under the control of stepping motors 8 and 11, and as described—on workpiece surface 34*a* preferably at the point where the stamping procedure should begin. Distance L1 (e.g. 1 mm) which results as shown in FIG. 5 is transferred to desired value generator 41 as a reference value, where it is modified to become a setpoint value for the stamping procedure, which corresponds to difference L2=L1−L3, in which case L3 is a fixedly specified setpoint value for the stamping depth. Next, the stamping procedure is started by switching on the control device as shown in FIG. 7, which results in the current output signal of distance sensor 33 being compared in comparator 40 with setpoint value L1−L3. The differential signal which is sent to controller 38 controls controlling device 39, e.g. the pressure control valve for the cylinder/piston system 21, 22 (FIG. 3), in a manner such that stamping needle 18 penetrates workpiece surface 34*a* to preselected stamping depth L3 (FIG. 6). As soon as this is indicated by distance sensor 33 in that its output value corresponds to distance L2, Y-motor 8 and X-motor 11 (FIG. 1) are switched on in order to write particular symbol 34*b* in surface 34*a*.

When the stamping procedure is completed, stamping needle 18 is lifted away from workpiece surface 34*a* via compression spring 30 by venting air from cylinder/piston system 21, 22, and it is moved to the starting point for the next symbol, one after the other, the method steps described above being repeated accordingly. A particular advantage of the present invention is that the determination of reference value L1 may be carried out anew every time before a new symbol is stamped. Even when stamping needle 18 becomes slightly worn when a symbol is stamped, or if the distance between tip 18*a* and the underside of sensor 33 may have changed for whatever reason, the next symbol is still scored with the specified stamping depth since, in this case, reference value L1 changes accordingly, and the differential value which is calculated in desired value generator 41 is adjusted accordingly. In this manner, it is possible to hold stamping depth L3 absolutely constant at least until stamping needle 18 has become worn to a value that is out-of-tolerance.

A further advantage of the present invention is that any bending of workpiece 34 is also accounted for in the calculation of reference value L1. If workpiece 34 is bent slightly, i.e. by stamping needle 18 before it penetrates surface 34*a*, this does not change reference value L1 which is required for control purposes, since distance sensor 33 constantly follows the movements of stamping needle 18. It is therefore particularly advantageous when distance sensor 33 is situated as close to stamping needle 18 as possible, i.e. as close as the installation conditions allow. Any deformations of workpiece 34 that occur have a negligible effect on reference value L1.

As a result of the present invention, it may therefore be ensured, even during a stamping phase, that a specified stamping depth L3 may indeed be attained and adhered to. If, for whatever reason, stamping depth L3 assumes a value that is outside of a specified tolerance range, which case may be monitored by comparator 40, the stamping procedure is preferably interrupted in order to ensure that erroneous markings are not created on workpiece surface 34*a*.

The monitoring of movements of stamping unit 1 relative to workpiece 34, which was described with reference to FIG. 4, also ensures that the stamping procedure is not disrupted by a faulty placement of stamping unit 1 on workpiece 34.

Finally, in a refinement of the present invention, it is also ensured that the various symbols are applied in the specified x- and y-positions, and that they are formed as intended. For this purpose, it is provided that a scale 43, e.g. in the form of line markings 42 or the like, is provided on guides 4 and 6 themselves or on a part of the main frame of Y-carriage 5 which is parallel thereto, and to assign a sensor 44 thereto which is mounted on a corresponding carriage which is X-carriage 7 in this case. When X-carriage 7 is displaced, sensor 43 counts, e.g. line markings 42 that it passes. The total number of line markings that were passed is compared with the expected value assigned to X-carriage 7; if they are the same, it is ensured that X-carriage 7 has reached the correct position. The same procedure is used for Y-carriage 5.

Figure 10:
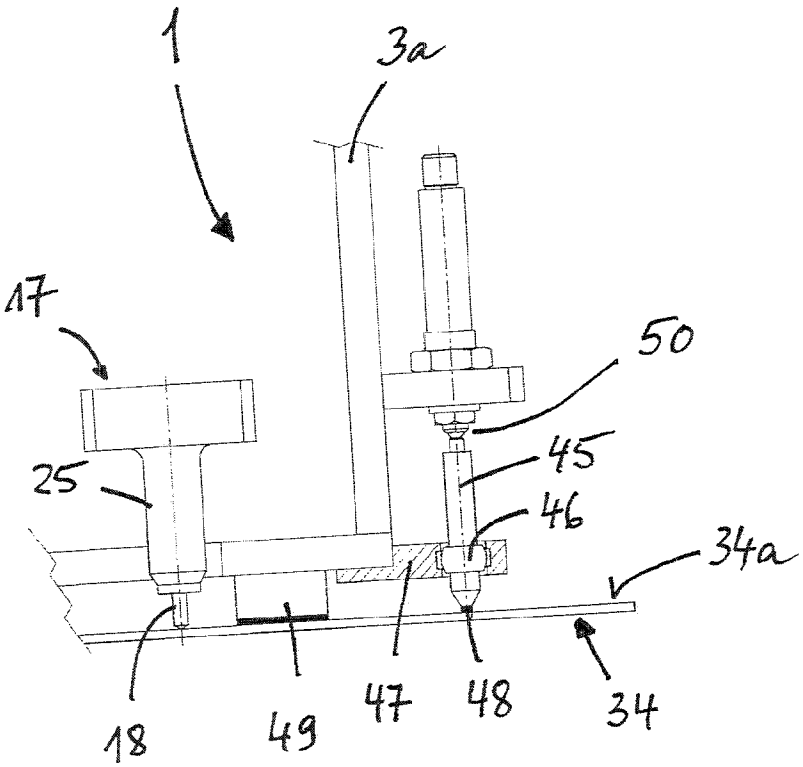
FIGS. 9 and 10 show a perspective illustration and a front view of a device which includes a mechanical probe for detecting relative movements between the stamping unit and the workpiece.
Figure 9:
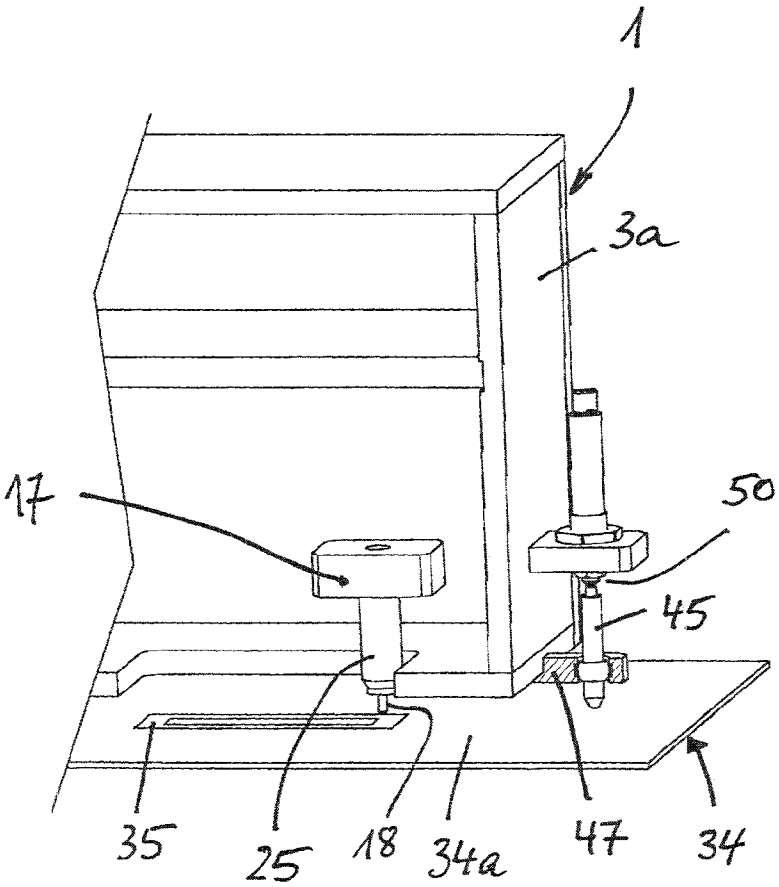

Finally, FIGS. 9 and 10 show an alternative embodiment of a device for detecting relative movements between stamping unit 1 and workpiece 34 during a stamping procedure. In contrast to FIG. 4, the device shown in FIGS. 9 and 10 includes a mechanical probe 45 which is mounted, e.g. on side wall 3*a*. Mechanical probe 45 is swivelably mounted via a ball joint 46 in a holder 47 which is connected to side wall 3*a*, and, when stamping needle 18 is lowered onto workpiece surface 34*a*, it rests on workpiece surface 34*a* via a rubber buffer 48. At the same time, stamping unit 1 is supported on workpiece surface 34*a* via at least one support leg 49. Relative displacements of stamping unit 1 and workpiece 34 in the x-direction and/or y-direction therefore result in probe 45 swiveling in ball joint 46. This swiveling is sensed by a sensor 50 which is assigned to the top side of probe 45 and operates via induction, and which is used to switch off the stamping procedure if the preselected tolerance range is exceeded.

The present invention is not limited to the exemplary embodiment described, which could be modified in various manners. This applies, in particular, for the type and design of the various sensors. Instead of distance sensor 33, which is particularly preferably a sensor which operates via inductance or based on the principle of eddy current, and which delivers analog or digital distance signals, it could be possible, e.g. to provide a sensor that operates via capacitance or optically. The statement "the attachment of distance sensor 33 to stamping needle 18" in the description and in the claims, below, is also intended, of course, to include the case in which distance sensor 33 is not connected directly to stamping needle 18, but rather to a holder that accommodates it, e.g. piston rod 28 (FIG. 3).

It may also be expedient to provide two or more distance sensors 33 which are distributed around the circumference of stamping needle 18. As a result, errors may be detected and compensated for that could arise from distance sensor 33 coming to rest over a groove of a symbol or part of a symbol created previously when stamping needle 18 penetrates workpiece surface 34*a*. It is also clear that the determination of stamping depth L3 described above is independent of whether the stamping of symbol 34*b* is carried out via scoring or plastic deformation of workpiece surface 34*a*. It is also expedient to situate distance sensor 33—since it must operate in a contactless manner—with its underside above tip 18*a* of stamping needle 18 at least so far that the distance measurement is carried out even when stamping needle 18 has become worn by a maximum tolerable amount.

The control device depicted in FIG. 7 may be modified by introducing a subtraction step 51—which is indicated by a dashed line—between distance sensor 33 and comparator 40, in which the difference between reference value L1 and distance L2 which is attained after the control device is switched on is calculated, the difference corresponding to the actual value of stamping depth L3. In this case, desired value generator 41 would specify only one expected value for stamping depth L3. In this case, stamping depth L3 is the actual controlled variable that must be regulated constantly. It is also clear that the monitoring of the various functionalities described above, and the control of stamping depth L3 are preferably carried out using microprocessor controllers or the like, and are therefore carried out fully automatically. Finally, it is understood that the features described may also be used in combinations other than those described and depicted herein.

It will be understood that each of the elements described above, or two or more together, may also find a useful application in other types of methods and constructions differing from the types described above.

While the invention has been illustrated and described as embodied in a method and device for creating a symbol in a workpiece surface via stamping, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A method for creating a symbol in a workpiece surface via stamping, comprising the steps of pressing a stamping needle into the workpiece surface and moving it parallel therewith; determining a resultant stamping depth of the symbol using a distance sensor; mounting the distance sensor on the stamping needle and moving the distance sensor therewith to be used as the distance sensor; placing the stamping needle on the workpiece surface before the stamping is begun; measuring a resultant first distance between the sensor and the workpiece surface; subsequently pressing the stamping needle into the workpiece surface; measuring a resultant second distance between the sensor and the workpiece surface; and determining the stamping depth from a difference of the two distances.

2. The method as defined in claim 1, further comprising regulating the stamping depth as a controlled variable constantly to a preselected value while the symbol is being created.

3. The method as defined in claim 2, further comprising pressing the stamping needle into the workpiece surface via an application of pressure, and regulating the stamping depth via an application of pressure as a manipulated variable.

4. The method as defined in claim 1, further comprising aborting the stamping of the symbol when the stamping depth reaches a value that is outside of a preselected tolerance range.

5. A device for creating a symbol in a workpiece surface via stamping, comprising: a stamping needle which is placeable on the workpiece surface and is movable parallel thereto; means for pressing the stamping needle into the workpiece surface in order to perform stamping; a distance sensor mounted on the stamping needle and set up to determine a stamping depth that is reached during a stamping procedure; and a device for detecting relative movements between a stamping unit and the workpiece during a stamping procedure, wherein the device for detecting relative movements between the stamping unit and the workpiece includes an optical sensor.

6. The device as defined in claim 5, wherein said distance sensor is situated directly next to the stamping needle and its underside is situated above an outer tip of the stamping needle at a distance that is at least as great as a desired stamping depth.

7. The device as defined in claim 5, wherein the needle head is mounted on a carriage which is displaceable in a first direction and a second direction and parallel to the workpiece surface, and wherein the stamping needle is supported in a needle head in a manner such that it may be moved back and forth in a third direction.

8. The device as defined in claim 7, wherein said means for pressing the stamping needle into the workpiece surface include a cylinder/piston system which acts on the stamping needle in the third direction.

9. The device as defined in claim 8, further comprising a control element for adjusting the pressure in the cylinder/piston system in a manner such that the stamping needle penetrates the workpiece surface to a preselected stamping depth.

10. The device as defined in claim 9, wherein said control element is a component of a control setup for the pressure.

11. The device as defined in claim 10, wherein said control element is configured so that a controlled variable used for the control setup is a stamping depth which results from a difference of a distance between the distance sensor and the workpiece surface when the stamping needle is situated thereon, and a distance between the distance sensor and the workpiece surface when the stamping needle is pressed into it.

12. The device as defined in claim 5, wherein the device for detecting relative movements between the stamping unit and the workpiece includes an mechanical probe.

13. The device as defined in claim 5, further comprising at least one additional distance sensor, said sensors being distributed around a circumference of the stamping needle.

14. The device as defined in claim 5, further comprising means for monitoring movements of the stamping needle in a direction selected from the group consisting of an x-direction, a y-direction, and both.

15. The device as defined in claim 5, wherein said distance sensor is mounted on a piston rod in which the stamping needle is installed in an easily-replaceable manner.

* * * * *